US005491918A

United States Patent [19]

Elmstedt

[11] Patent Number: 5,491,918

[45] Date of Patent: Feb. 20, 1996

[54] FIREARM SAFETY AND SECURITY DEVICE

[76] Inventor: Mark R. Elmstedt, 191 Bayberry Dr., Bristol, Conn. 06010

[21] Appl. No.: 297,316

[22] Filed: Aug. 29, 1994

[51] Int. Cl.[6] ..... F41A 17/44

[52] U.S. Cl. ..... 42/70.11

[58] Field of Search ..... 42/70.11, 96

[56] References Cited

U.S. PATENT DOCUMENTS

| | | | |
|---|---|---|---|
| 2,479,107 | 8/1949 | Garretson | 42/70.11 |
| 2,887,807 | 5/1959 | Santangelo | 42/1 |
| 3,720,014 | 3/1973 | Goodrich | 42/1 N |
| 4,224,753 | 9/1980 | Bielman | 42/1 LP |
| 4,398,366 | 8/1983 | Wernicki | 42/70.11 |
| 4,512,099 | 4/1985 | Mathew | 42/1 LP |
| 4,783,924 | 11/1988 | Thurber | 42/70.11 |
| 4,908,971 | 3/1990 | Chaney | 42/70.11 |
| 4,999,940 | 3/1991 | Madden | 42/70.11 |
| 5,001,854 | 3/1991 | Derman | 42/70.11 |
| 5,038,508 | 8/1991 | Brown | 42/70.11 |
| 5,048,211 | 9/1991 | Hepp | 42/70.11 |
| 5,054,223 | 10/1991 | Lee | 42/70.11 |
| 5,115,589 | 5/1992 | Shuker | 42/70.11 |
| 5,138,785 | 8/1992 | Paterson | 42/70.11 |
| 5,171,924 | 12/1992 | Honey et al. | 42/70.11 |
| 5,289,653 | 3/1994 | Szebeni et al. | 42/70.11 |

*Primary Examiner*—Charles T. Jordan
*Assistant Examiner*—Theresa M. Wesson

[57] ABSTRACT

A firearm lock that utilizes two separable parts. When locked in place they fully occupy a gun's barrel and chamber. One part, a dummy round, has a tubular forward area with a recessed inner groove proportioned to accept the second part so that the two can be locked together. The other part uses a tubular bore bar permanently attached to an adapted lock with an actuating rod located through the length of both to provide a way of locking and unlocking the device. A plurality of slots are cut in the bore bar's inner end so as to create a series of flexible tines. When in the locked position, the actuating rod extends through the bore bar's inner end, and the tines cannot move. When unlocked, the actuating rod can move to provide room for the tines to flex so that insertion and withdrawal from the dummy round can be accomplished. The locking and unlocking of the device is achieved by restricting the axially movement of the actuating rod with a lock engaging portion located inside the adapted lock.

1 Claim, 2 Drawing Sheets

FIREARM SAFETY AND SECURITY DEVICE

BACKGROUND—FIELD OF THE INVENTION

This invention relates to devices that are designed to prevent unauthorized or accidental discharges of firearms.

BACKGROUND—DESCRIPTION OF THE PRIOR ART

At this present time numerous variety of firearm locks and safety devices are available. All of which are generally aimed at the basic enhancement of safety as well as security. An exemplary firearm safety device should possess at least four distinct qualities. The first being, a good positive mechanical lock. To rely on friction or tension to secure a gun may deter a weaker adolescent, but it will probably not defeat a stronger, more determined individual. Secondly, speed and ease off, installation and removal are very important. If numerous steps are required or the procedure for installation is complicated, this could eventually result in the device not being used. Also if a weapon must be reassembled the defensive function for which most people own a firearm will be delayed or gone. Third, the economy of the device must be considered. Numerous parts or parts that require extensive intricate machining all go to raise the eventual cost of the device. Each device should contain a minimal number of parts and as little machining as possible. Lastly, it should not damage the firearm to be secured. Devices that are free to move about or that require friction or tension be maintained on a critical portion of a firearm should generally be avoided. Excessive movement or friction can cause accelerated surface wear, detracting from the firearms appearance as well as value. Accuracy can also be affected by damage incurred to the chamber, bore or critical area known as the forcing cone where the bore and chamber meet. This also means that the device should have an external indicator to show whether the device is locked or unlocked. This would eliminate the attempted withdrawal and possible damage of the firearm secured.

Some of the prior art relevant to this device are the following U.S. Pat. Nos.: 2,479,107; 2,887,807; 3,720,014; 4,224,753; 4,398,366; 4,512,099; 4,783,924; 4,908,971; 4,999,940; 5,001,854; 5,038,508; 5,048,211; 5,054,233; 5,115,589 and 5,289,653.

U.S. Pat. No. 4.398,366, to Wernicki on Aug. 16, 1983 is a good security device, but elimination of the locking balls would be an improvement because this elimination would simplify manufacturing and assembly, particularly for the smaller caliber firearms.

U.S. Pat. No. 4,783,924 to Thurber on Nov. 15, 1988 achieves a certain amount of safety but relies on manual pressure for insertion and withdrawal. Deterrance to unauthorized removal is minimal.

U.S. Pat. No. 5,038,508 to Brown on Aug. 13, 1991 is a device with an involved installation procedure Security is achieved, but the process is time consuming. Also, the weapon cannot be used quickly if needed.

U.S. Pat. No. 5,054,223 to Lee on Oct. 8, 1991 is a device that uses numerous parts.

U.S. Pat. No. 5,115,589 to Shuker on May s26, 1992 is an example of a device that is designed to damage a firearm. Unless a device of this nature is truly needed, it should generally be avoided. If accuracy is a paramount consideration, U.S. Pat. No. 4,512,099 to Mathew on Apr. 23, 1985 and U.S. Pat. No. 5,289,653 to Szebeni et al. on Mar. 1, 1994 could be viewed as devices that might affect a firearm. Devices like these that secure onto the chamber or forcing cone area might lead a person to chose a different type of security device because of accuracy concerns. Also by not extending fully to the end of the chamber it does allow for attempted insertion of ammunition. If this happens with an automatic, semi-automatic or bolt action firearm that utilizes rimfire ammunition, a hazardous situation could occur. Also the latter provides no external indicators as to whether the device is locked or unlocked.

To minimize or even eliminate all these problems would be a major advancement in firearm safety and security.

OBJECTS AND ADVANTAGES

Accordingly, several objects and advantages of my invention are that it provides a means of positively locking a firearm while maintaining its function as a readily available security device. By positively indicating its locking status and extending completely through the muzzle and chamber, damage will not be caused through excessive movement or tension on critical areas. Along with providing a device that is very simple to use, its price will be affordably low because of the amount of machining needed to manufacture the device will be minimal and not of a complex nature. All of this means that the public will have available to it an affordable means of positively locking a firearm that they will continue to use because of its simple installation and speedy withdrawal if needed.

DRAWING FIGURES

To better understand the invention to be described, references will be made to the following drawings, wherein.

Figure 3:
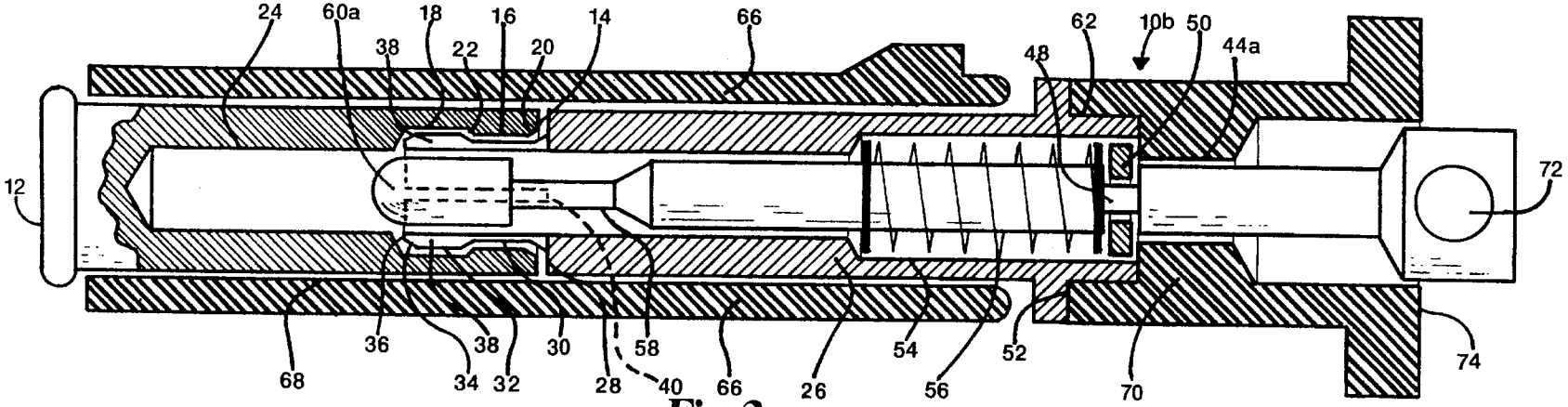
FIG. 3 shows a partial cross-sectional view of an alternate embodiment installed and ready to be locked by insertion of a common use shackle type lock.
Figure 3A:
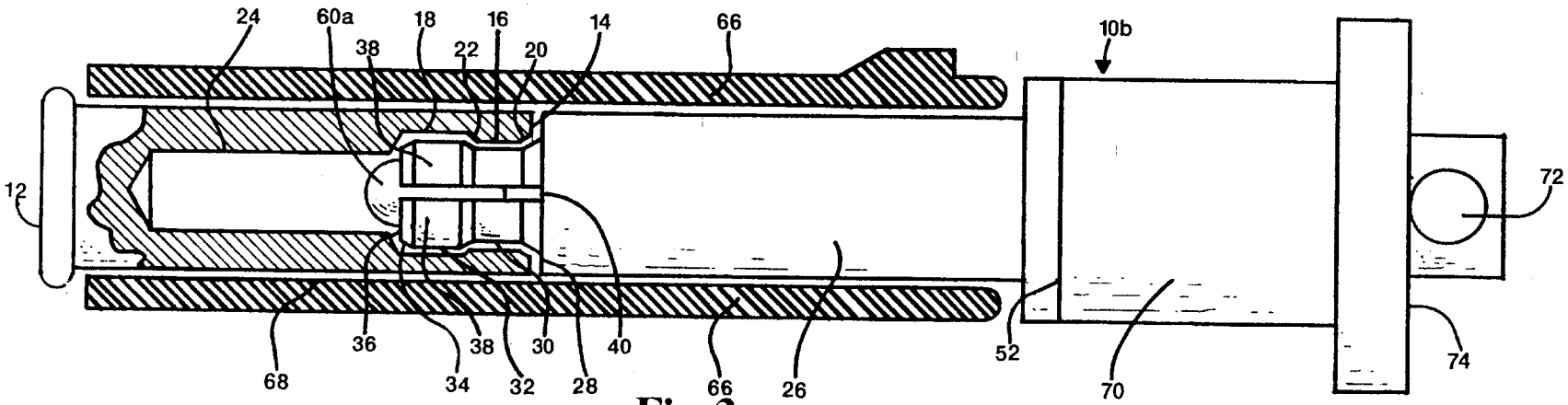

FIG. 3*a* shows a locking insert of an alternate embodiment inserted in a partially cross-sectioned locking cartridge installed and ready to be locked by insertion of a common use shackle type lock.

REFERENCE NUMERALS IN DRAWINGS

10, 10*a*, 10*b* locking insert
12, 12*a* receiving cartridge
14 cartridge front end
16 hole
18 recessed detent tine receiving area or recessed area
20 exterior chamfer
22 interior chamfer
24 tine saver area
26 bore bar
28 bore bar forward shoulder
30 small diameter
32 large diameter
34 front chamfer
36 bore bar inner end
38 locking detent tines
40 slots
42 adapted common use locking means

**44,44*a*** actuating rod through hole
46 locking groove
48 retainer clip groove
50 retainer clip
52 stop shoulder
54 return spring housing area
56 return spring
58 tine groove
**60,60*a*** actuating rod
62 bore bar adaptor
64 key
**66,66*a*** barrel
**68,68*a*** chamber
70 passive locking sleeve
72 shackle type lock through hole
74 sleeve face

SUMMARY OF THE INVENTION

Herein is a brief summary of this device which is designed as a lock that can be used on any firearm utilizing a tubular barrel aligned with a chamber for receiving a round of ammunition appropriate for said firearm. This cartridge and bore type locking device consists of four basic elements: a dummy round or receiving cartridge which will be dimensionally similar to a round of ammunition for said firearm while having a tubular forward portion dimensioned to allow for the introduction and acceptance of a novel locking means; an adapted common use locking means; a tubular rod or bore bar permanently adjoined to said common use locking means by a suitable means such as welding, brazing or permanent type epoxy, etc. so as to distally facilitate said locking mechanism between said common use locking means and said receiving cartridge; and an actuating rod centrally located through the length of said bore bar and through said common use locking means to provide a means of distally actuating the locking and unlocking between said common use locking means and said receiving cartridge. Although this device can be used on any firearm, it is especially well suited for handguns.

DESCRIPTION—FIG. 1 To FIG. 3*a*

Figure 1:
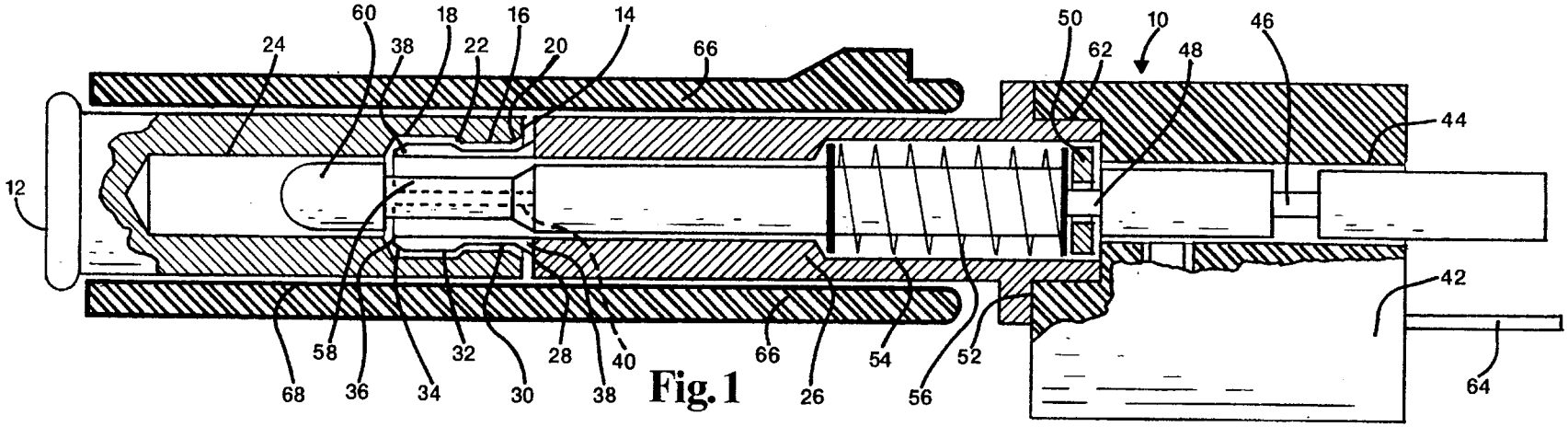
FIG. 1 shows a partial cross-sectional view of the preferred embodiment installed and in the unlocked position.
Figure 2:
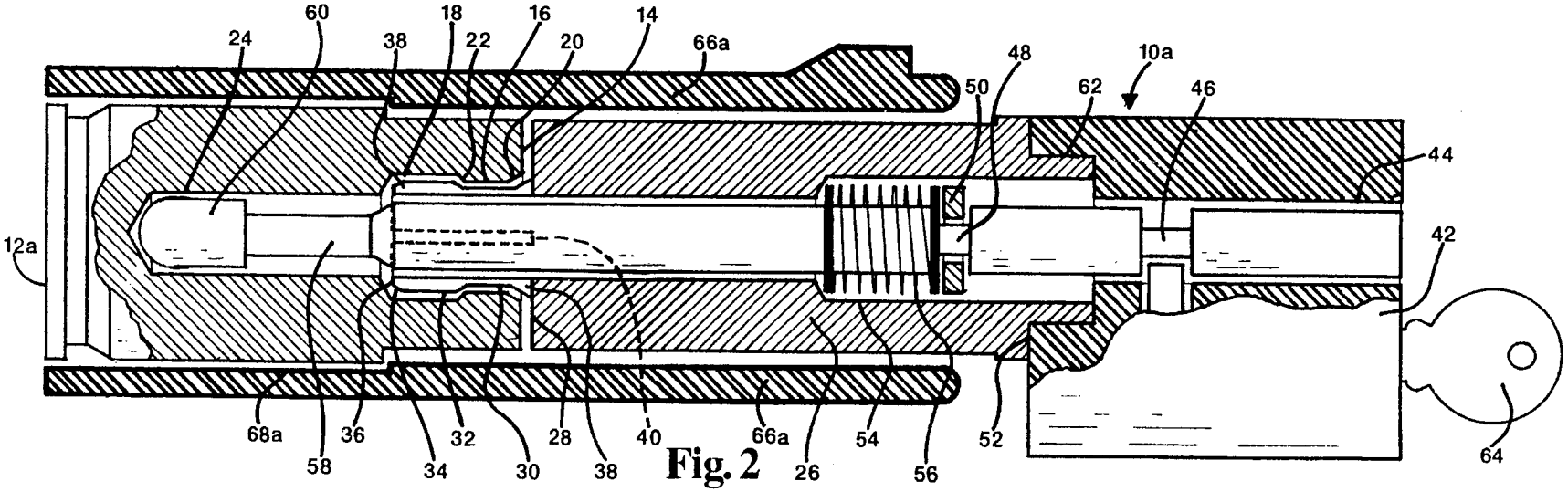
FIG. 2 shows a partial cross-sectional view of the preferred embodiment [a larger caliber is shown] installed so as to lock and secure a firearms barrel and chamber.

In FIG. 1 is shown the preferred embodiment installed and unlocked in a barrel 66 and a chamber 68 ready to be locked so as to prevent unauthorized or accidental discharge. This device is a combination of two separable parts. One being a receiving cartridge 12 and the other is a combination of several assembled pieces designated locking insert 10.

Receiving cartridge 12 will have exterior dimensions similar to a round of ammunition for the gun to be locked. The forward portion of receiving cartridge 12 will be tubular in nature. Reference numeral 14 will be used to identify the front end of receiving cartridge 12 and will be further referred to as cartridge front end 14. The tubular forward portion of receiving cartridge 12 will progress from cartridge front end 14 to a hole 16 by way of a circumferential chamfer designated exterior chamfer 20. Further into receiving cartridge 12, past hole 16, will be a recessed detent tine receiving area or simply recessed area 18. Recessed area 18 and hole 16 will be connected by a circumferential chamfer or interior chamfer 22. Recessed area 18 will be in the form of a circumferential groove of a slightly larger diameter than hole 16. Lastly, the tubular portion will end with a tine saver area 24. Area 24 will be just large enough to freely accept an actuating rod 60 when it is fully extended in the locked position. The purpose of exterior chamfer 20 is to facilitate and guide locking insert 10 upon entry to receiving cartridge 12. The purpose of chamfer 22 is to facilitate and ease the detachment of locking insert 10 when extraction from receiving cartridge 12 is desired. These areas can be better understood by viewing FIG. 1, FIG. 2, and FIG. **3*a*. Although chamfer 20** is not absolutely necessary for the device to function, it will be included in all figures.

Locking insert 10 is made of five individual parts: a bore bar 26, an adapted common use locking means 42, a retainer clip 50, a return spring 56, and actuating rod 60. When these five parts are permanently assembled, they make a completed locking insert 10.

Bore bar 26 consists of an elongated tubular member with the majority of its length of a diameter that would snugly fit in barrel 66 of the firearm to be locked. Located at the inner end of bore bar 26 is an area referred to as bore bar inner end 36. Located past inner end 36 on bore bar 26 is a large diameter 32 and a small diameter 30. Large diameter 32 and inner end 36 will be connected by a circumferential chamfer designated front chamfer 34. The function of chamfer 34 is to guide and facilitate insertion of locking insert 10 into receiving cartridge 12. The size of large diameter 32 should be similar but slightly smaller than that of recessed area 18 but also larger than the diameter of hole 16. The diameter of small diameter 30 should be similar but slightly smaller than hole 16. The length of small diameter 30 should be slightly greater than the depth of hole 16. The area where small diameter 30 meets the near full bore diameter of bore bar 26 will be referred to as bore bar forward shoulder 28. The length from forward shoulder 28 to inner end 36 should be slightly less than the length from cartridge front end 14 to the inner end of recessed area 18. Longitudinally cut will be a plurality of slots designated slots 40. Four slots will be used on the preferred embodiment. Slots 40 will extend from inner end 36 to forward shoulder 28 and be equidistant apart. When slots 40 are cut, this creates four reflexive tines referred to as locking detent tines 38.

At the opposite end from tines 38 on bore bar 26 will be a cylindrical counter bored area referred to as return spring housing area 54. Area 54 will be used to house return spring 56 and retainer clip 50. The diameter of area 54 should be just large enough to allow return spring 56 and retainer clip 50 to move unhindered. The depth of area 54 should be such that when actuating rod 60 is moved to the locked position, return spring 56 will be at almost full compression. When actuating rod 60 is in the unlocked position, return spring 56 will be at almost full extension. Bore bar 26 will be attached to locking means 42 with a bore bar adaptor 62. A stop shoulder 52 will be a circumferential shoulder of a diameter slightly greater than bore bar adaptor 62. Stop shoulder 52 is used to provide a constant seating depth as well as provide a neat appearance. Although not critical to the function of the device, stop shoulder 52 will be shown on all views. Bore bar adaptor 62 is designed to allow for the secure attachment of bore bar 26 to common use locking means 42. Adaptor 62 also facilitates accurate alignment of bore bar 26 and actuating rod 60 with an actuating rod through hole 44. This accurate alignment allows actuating rod 60 free movement to and from the locked and unlocked position.

The purpose of actuating rod 60 is twofold. The first being to provide a distal means of locking and unlocking the device. Second, by extending past inner end 36 it minimizes the possibility of damage to tines 38 by excessive bending. Actuating rod 60 is a cylindrical rod with three circumferential grooves: a locking groove 46, a retainer clip groove 48, and a tine groove 58. Locking groove 46 is positioned inside actuating rod through hole 44. Its location is such that when actuating rod 60 is moved to the locked position, it will engage the locking mechanism of locking means 42. Actuating rod 60 will stay immobilized until such time as locking means 42 is unlocked by an appropriate key 64. Retainer clip groove 48 is located on the inside of return spring housing area 54 toward the very end of bore bar adaptor 62 when in the unlocked position. Retainer clip groove 48 is designed to accept retainer clip 50 which functions to prevents complete withdrawal of actuating rod 60 by being of a larger diameter than hole 44. Also, by being at least as large as return spring 56, it provides a shoulder which allows actuating rod 60 to be propelled from the locked to the unlocked position when locking means 42 is unlocked. Tine groove 58, although not absolutely necessary to the function of the device in FIG. 1 and FIG. 2, it will be included on the preferred embodiment. Tine groove 58 will be in the form of a circumferential groove that will be the length of tines 38 when in the unlocked position and of the largest diameter possible while still allowing tines 38 to function unhindered. If actuating rod 60 were to end at bore bar forward shoulder 28 when in the unlocked position, the device would still function, but tines 38 would be more susceptible to damage through excessive bending.

FIG. 3 and FIG. 3*a* show an alternate embodiment in the passive secure position. A locking insert 10*b* is made when a passive locking sleeve 70 is connected to bore bar 26 in the same way as in the preferred embodiment. Sleeve 70 will utilize an actuating rod through hole 44*a*. To provide a means of positively securing locking insert 10*b*, an actuating rod 60*a* will utilize a shackle type lock through hole 72. Hole 72 will be located on actuating rod 60*a* so that when in the locked position it will be nearly parallel to a sleeve face 74. Although not detailed, passive security can be increased by simply positioning a common use shackle type lock through hole 72, thereby immobilizing actuating rod 60*a* till said lock is removed.

OPERATION

To secure a firearm with the preferred embodiment, it should be installed in the following manner. To start insert receiving cartridge 12 into the chamber of the firearm to be secured. If used to secure a revolver, the cylinder should be closed with receiving cartridge 12 in alignment with the bore of barrel 66. On automatic, semi-automatic and bolt action firearms, the slide or bolt should be brought forward into battery in the same manner as if loading a round of ammunition. Once receiving cartridge 12 has been installed as described, the firearm is ready to be secured by the installation of locking insert 10. To start make sure locking insert 10 is unlocked. This can be done by visually checking to assure that actuating rod 60 is extended past locking means 42 and that tine groove 58 is not extended past tines 38. Assured that locking insert 10 is unlocked, position tines 38 in front of the muzzle of barrel 66. After axially orienting locking insert 10 with the bore of barrel 66, slide insert 10 fully down barrel 66 until you feel bore bar forward shoulder 28 stop as it meet cartridge front end 14. When this happens there will be an audible click. This sound is tines 38 reflexively moving back to their original position after completely passing through hole 16. To complete the locking sequence, press actuating rod 60 toward locking means 42 till it stops and another audible click is heard. This sound is common use locking means 42 engaging locking groove 46. When this happens, actuating rod 60 is immobilized and said firearm is secured.

Removal of this device can be accomplished as follows. To start insert and turn key 64 so as to release actuating rod 60. This causes return spring 56 to propel actuating rod 60 to the unlocked position and locking insert 10 can be withdrawn from barrel 66. After locking insert 10 has been removed, the firearm can be cycled to chamber a round of ammunition if desired.

Operation of the alternate embodiment is similar to the preferred embodiment. Locking cartridge 12 is inserted in the same manner. Locking insert 10*b* can be inserted into receiving cartridge 12 by firstly moving actuating rod 60*a* forward till tine groove 58 allows free movement of tines 38. When this happens locking insert 10*b* can be inserted into receiving cartridge 12 the same as in the preferred embodiment. To remove the alternate embodiment, press actuating rod 60*a* forward till tines 38 can move inwardly and removal of locking insert 10*b* can be accomplished.

CONCLUSION, RAMIFICATIONS, AND SCOPE OF THE INVENTION

Thus it can be seen that this firearm lock embodies a device that fills the needs of most firearm owners. A device of this type that: 1) positively locks the weapon, 2) is easy to use, 3) doesn't damage the weapon, 4) provides a visible indicator of locked status, and 5) positively prevents the introduction of ammunition, is a device with a lot of potential to save lives. Even though firearm accidents are on the decline at this time, the public might truly welcome a new device like this if given the chance.

Although the above description contains many specifications, these should not be construed as limiting the scope of the invention but as merely providing illustrations of some of the presently preferred embodiment of this invention. For example, the number of tines used could be other than four, and the receiving cartridge can be eliminated by raising the bore bar small diameter to full bore size and also raising the bore bar large diameter to just larger than the full bore diameter as the lock will still function but not with the same efficiency as with the receiving cartridge, etc.

Thus the scope of the invention should be determined by the appended claims and their legal equivalents, rather than by the examples given.

I claim:

1. A device for locking a firearm that extends through a firearm's muzzle and chamber, wherein said firearm utilizes said chamber for receiving a round of ammunition in axial alignment with a firearm's barrel, said device comprising:

a) a receiving cartridge with exterior dimensions similar to said round of ammunition for said firearm's chamber, wherein said receiving cartridge will have a tubular forward end contiguous with a recessed tine receiving area for engagement of a locking and unlocking means;

b) an elongated tubular rod dimensioned to fully occupy said firearm's barrel and extend from said firearm's muzzle into said firearm's chamber, located on said elongated tubular rod will be an adaptor means for permanently coupling said elongated tubular rod to an adapted common use locking means, opposite said elongated tubular rod will be a plurality of reflexive locking detent tines to function as a distal locking means with said recessed detent tine receiving area, each of said reflexive locking detent tines having a bore bar forward shoulder to engage said elongated tubular rod and a large diameter bulge to engage said recessed detent tine receiving area;

c) an actuating rod axially positioned through said elongated tubular rod and through said adapted common use locking means while having a lock engaging portion positioned inside said adapted common use locking means so as to provide said locking and unlocking means by distal transmission between said adapted common use locking means and said reflexive locking detent tines and;

d) said adapted common use locking means permanently abutted to said elongated tubular rod, whereby when said device is installed and locked in said firearm it will fully occupy said firearm's chamber and said firearm's barrel so as to prvide a means of assuring that said firearm is not loaded and cannot be loaded until said device is unlocked and removed from said firearm.

* * * * *